US010220224B2

(12) United States Patent
Langford

(10) Patent No.: US 10,220,224 B2
(45) Date of Patent: Mar. 5, 2019

(54) SWITCHABLE EXHALE FILTER SYSTEM

(71) Applicant: SCOTT HEALTH & SAFETY LIMITED, Lancashire (GB)

(72) Inventor: Graham Langford, Merseyside (GB)

(73) Assignee: Scott Health & Safety Limited, Boca Raton, FL (US)

( * ) Notice: Subject to any disclaimer, the term of this patent is extended or adjusted under 35 U.S.C. 154(b) by 1064 days.

(21) Appl. No.: 14/615,829

(22) Filed: Feb. 6, 2015

(65) Prior Publication Data

US 2015/0151143 A1 Jun. 4, 2015

Related U.S. Application Data

(63) Continuation of application No. PCT/GB2013/051974, filed on Jul. 24, 2013.

(30) Foreign Application Priority Data

Aug. 6, 2012 (GB) ..... 1214088.5

(51) Int. Cl.
*A62B 9/02* (2006.01)
*A62B 18/02* (2006.01)
(Continued)

(52) U.S. Cl.
CPC ..... *A62B 9/02* (2013.01); *A62B 7/10* (2013.01); *A62B 9/022* (2013.01); *A62B 18/006* (2013.01);
(Continued)

(58) Field of Classification Search
CPC ..... A61M 16/00; A61M 16/06; A61M 16/20; A61M 16/208; A62B 7/00; A62B 7/02;
(Continued)

(56) References Cited

U.S. PATENT DOCUMENTS 2,406,888 A 9/1946 Meidenbauer
2,985,169 A 5/1961 Elting
(Continued)

FOREIGN PATENT DOCUMENTS

CN 101426555 A 5/2009
JP 2006-520666 A 9/2006
(Continued)

OTHER PUBLICATIONS

1st Australian Examination Report dated Jun. 22, 2016 for corresponding Australian National Stage Application Serial No. 2013301413, Australian National Stage Entry Date: Feb. 5, 2015, consisting of 3 pages.

(Continued)

*Primary Examiner* — Colin W Stuart
(74) *Attorney, Agent, or Firm* — Christopher & Weisberg, P.A.

(57) ABSTRACT

A configurable exhale system for a respirator has a first valve assembly disposed within a chamber which is configured to prevent air from flowing through the first valve assembly when an air pressure differential between an upstream side and a downstream side of the first valve assembly is below a first opening pressure. A second valve assembly is disposed within the chamber in fluid communication with the first valve assembly which is configured to prevent air from flowing through the second valve assembly when an air pressure differential between an upstream side and a downstream side of the second valve assembly is below a second opening pressure, which is greater than the first opening pressure. A bypass opening is positioned adjacent the second valve assembly configured to enable air to bypass the second valve assembly with a bypass member positioned adjacent to the bypass opening. The bypass member is movable between two positions with the bypass member blocking the bypass
(Continued)

opening in a first position and the bypass member does not block the bypass opening in a second position.

14 Claims, 5 Drawing Sheets

(51) Int. Cl.

| | |
|---|---|
| ***A62B 18/08*** | (2006.01) |
| ***A62B 7/10*** | (2006.01) |
| ***A62B 18/10*** | (2006.01) |
| ***A62B 18/00*** | (2006.01) |
| ***A62B 18/04*** | (2006.01) |

(52) U.S. Cl.
CPC ..... *A62B 18/02* (2013.01); *A62B 18/025* (2013.01); *A62B 18/045* (2013.01); *A62B 18/08* (2013.01); *A62B 18/10* (2013.01)

(58) Field of Classification Search
CPC .... A62B 7/04; A62B 7/10; A62B 9/02; A62B 9/022; A62B 18/00; A62B 18/02; A62B 18/025; A62B 18/04; A62B 18/045; A62B 18/06; A62B 18/10
USPC ..... 128/205.24, 206.15
See application file for complete search history.

(56) References Cited

U.S. PATENT DOCUMENTS

| | | | | |
|---|---|---|---|---|
| 3,933,171 | A * | 1/1976 | Hay | A61M 16/208 128/205.24 |
| 5,002,050 | A * | 3/1991 | McGinnis | A61M 16/208 128/204.18 |
| 2008/0035149 | A1 * | 2/2008 | Sutton | A62B 18/10 128/205.24 |
| 2008/0257352 | A1 | 10/2008 | Penton et al. | |
| 2010/0236554 | A1 | 9/2010 | Prete | |

FOREIGN PATENT DOCUMENTS

| | | | |
|---|---|---|---|
| JP | 2007-236814 | A | 9/2007 |
| JP | 2008-514302 | A | 5/2008 |
| WO | WO9826830 | A1 | 6/1998 |
| WO | 2006/037000 | A1 | 4/2006 |
| WO | 2010131031 | A2 | 11/2010 |
| WO | 2004/093997 | A1 | 11/2014 |

OTHER PUBLICATIONS

Official Action and English translation of same dated Dec. 20 2016, issued in corresponding Eurasian Patent Application No. 201590333131, consisting of 4-pages.

Written Opinion of the Intellectual Property Office of Singapore dated Jul. 26, 2016 issued in corresponding Singapore Patent Application No. 11201500893P, consisting of 6-pages.

Chinese Office Action and English translation of same dated Oct. 10, 2016 issued in corresponding Chinese Patent Application No. 201380047430.2, consisting of 15-pages.

Japanese Office Action and English translation of same dated Apr. 25, 2017 issued in corresponding Japanese Patent Application No. 2015-525935, consisting of 8-pages.

* cited by examiner

SWITCHABLE EXHALE FILTER SYSTEM

CROSS-REFERENCE TO RELATED APPLICATIONS

This application is a continuation of International Application No. PCT/GB2013/051974 filed Jul. 24, 2013, which claims priority to GB Application No. 1214088.5 filed Aug. 6, 2012, the contents of both of which are incorporated herein by reference.

The disclosure relates generally to the field of respirators, and more particularly to a switchable exhale system for respirators.

BACKGROUND OF THE INVENTION

Respirators have long been used for purifying ambient air and for providing users with breathable air supplies in hazardous environments in which a user may encounter contaminated air. Such environments may present various types and concentrations of air contaminants. Different types of respirators have therefore been developed for providing different levels of protection.

Perhaps the most basic variety of respirator is an air purifying respirator (APR). The air pressure inside of a breathing mask that employs an APR is negative during inhalation with respect to the ambient pressure outside the mask. As a user inhales, air is drawn from the ambient atmosphere, through an air purifying filter, and into the mask. The user then exhales through an exhalation unit that typically includes a check valve that provides a relatively small exhalation resistance. The APR therefore resists the entry of unfiltered ambient air into the mask, but allows exhaled air to exit the mask with relatively little resistance. A problem commonly associated with APRs is that they can be susceptible to contamination if leaks develop in the respirator or between the mask and the wearer. APRs may therefore be sufficient for certain, low-contaminant environments, but are generally insufficient for environments the present relatively high levels of contamination.

A more protective respirator is a self-contained breathing apparatus (SCBA). SCBA units include an air tank containing compressed purified air. The tank provides positive pressure air to a respirator mask. Air enters the mask through a demand valve that opens when the user inhales. The cracking pressure of the exhalation unit check valve is greater than the cracking pressure of the demand valve to prevent continuous flow of air through the respirator. In this way, air flows into the respirator during inhalation but ceases to flow during exhalation. In addition to providing an independent source of pure air, SCBA respirators are advantageous in the continuous, positive air pressure inside the mask of a SCBA unit effectively prevents the ingress of ambient air. However, a problem commonly associated with SCBA respirators is that they can be relatively loud, and the source of air is limited to the volume of the associated bottle. Thus, the SCBA arrangement may not be optimal for all environments, especially those in which a user wishes to remain inconspicuous (e.g., for law enforcement and military use).

In view of the foregoing, it is apparent that if a user wishes to be prepared for different types of environments that may require different types of respirators, the user must carry and maintain multiple types of respirators. This can be very cumbersome and inconvenient. It would therefore be desirable to provide a respirator that can quickly and easily be converted for use in various operation modes, including APR and SCBA.

SUMMARY OF THE INVENTION

A configurable exhale system is disclosed for use in a respirator. The system may comprise a housing having a chamber and a first valve assembly disposed within the chamber and configured to prevent air from flowing through the first valve assembly when an air pressure differential between an upstream side and a downstream side of the first valve assembly is below a first opening pressure. The system may further include a second valve assembly disposed within the chamber in fluid communication with the first valve assembly, the second valve assembly configured to prevent air from flowing through the second valve assembly when an air pressure differential between an upstream side and a downstream side of the second valve assembly is below a second opening pressure, where the second opening pressure is greater than the first opening pressure. The system may also include at least one bypass opening positioned adjacent the second valve assembly, where the at least one bypass opening is configured to enable air to bypass the second valve assembly. A bypass member may be positioned adjacent the at least one bypass opening. The bypass member may be movable between first and second positions. In the first position the bypass member may block the at least one bypass opening. In the in the second position the bypass member may not block the at least one bypass opening. In one embodiment, moving the bypass member between the first and second positions comprises axial movement of the bypass member. In another embodiment, moving the bypass member between the first and second positions comprises rotational movement of the bypass member.

In some embodiments, the system comprises a removable cartridge. In other embodiments, the system comprises a built-in feature of a respirator. In some embodiments, moving the bypass member between the first and second positions is initiated manually by a user. In other embodiments, moving the bypass member between the first and second positions is initiated automatically based on a change of state or an aspect of a respirator associated with the system. In further embodiments, the change of state or an aspect of a respirator associated with the system is selected from the list consisting of: the wearer turning on the cylinder, enabling a function of a demand valve, and creating an abnormal pressure condition in an internal volume of the respirator.

A method is disclosed for providing a switchable exhale filter system for a respirator. The method may include providing a housing having a first and second valve assemblies in fluid communication with each other. The first valve assembly may be configured to prevent air from flowing through the first valve assembly when an air pressure differential between an upstream side and a downstream side of the first valve assembly is below a first pressure. The second valve assembly may be configured to prevent air from flowing through the second valve assembly when an air pressure differential between an upstream side and a downstream side of the second valve assembly is below a second pressure. The second pressure may be greater than the first pressure. The method may further include providing at least one opening adjacent the second valve assembly for allowing air to bypass the second valve assembly; providing a bypass member adjacent the at least one opening; and moving the bypass member between first and second positions, wherein in the first position the bypass member does not block the opening and allows air to flow through the opening to bypass the second valve assembly, and wherein in the second position the bypass member blocks the opening to prevent air from bypassing the second valve assembly. In some embodiments, moving the bypass member between the first and second position comprises moving the bypass member axially. In other embodiments, moving the bypass member between the first and second position comprises rotating the bypass member.

In some embodiments, the system comprises a removable cartridge. In other embodiments, the system comprises a built-in feature of a respirator. In some embodiments, moving the bypass member between first and second positions is initiated manually by a user. In other embodiments, moving the bypass member between first and second positions is initiated automatically based on a change of state or an aspect of a respirator associated with the system. In further embodiments, the change of state or an aspect of a respirator associated with the system is selected from the list consisting of: the wearer turning on the cylinder, enabling a function of a demand valve, and creating an abnormal pressure condition in an internal volume of the respirator.

DETAILED DESCRIPTION OF THE DRAWINGS

By way of example, specific embodiments of the disclosed device will now be described, with reference to the accompanying drawings, in which.

DETAILED DESCRIPTION OF THE INVENTION

Figure 1:
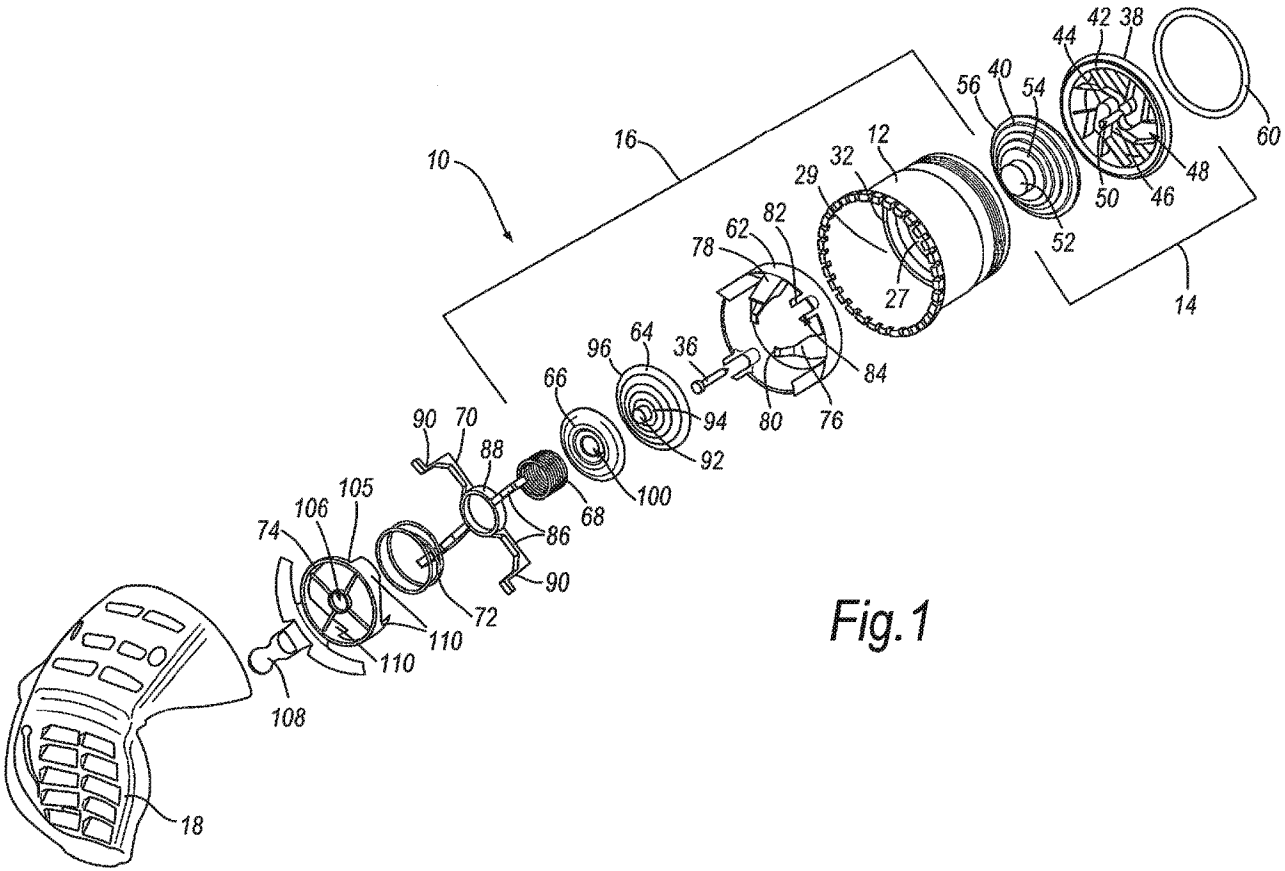
FIG. 1 is an exploded view illustrating an embodiment of a switchable exhale system in accordance with the present disclosure.
Figure 2:
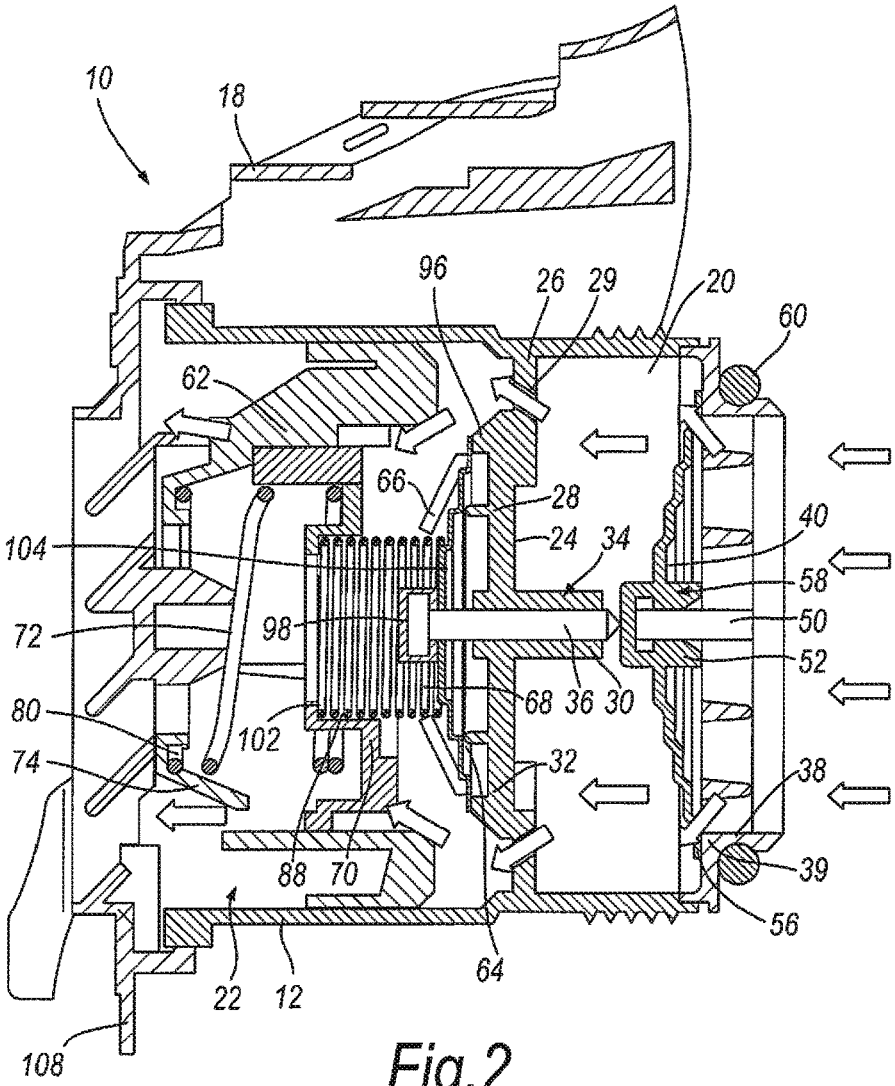
FIG. 2 is cross-section view of an embodiment of a switchable exhale system in accordance with the present disclosure in an inactive configuration.
Figure 3:
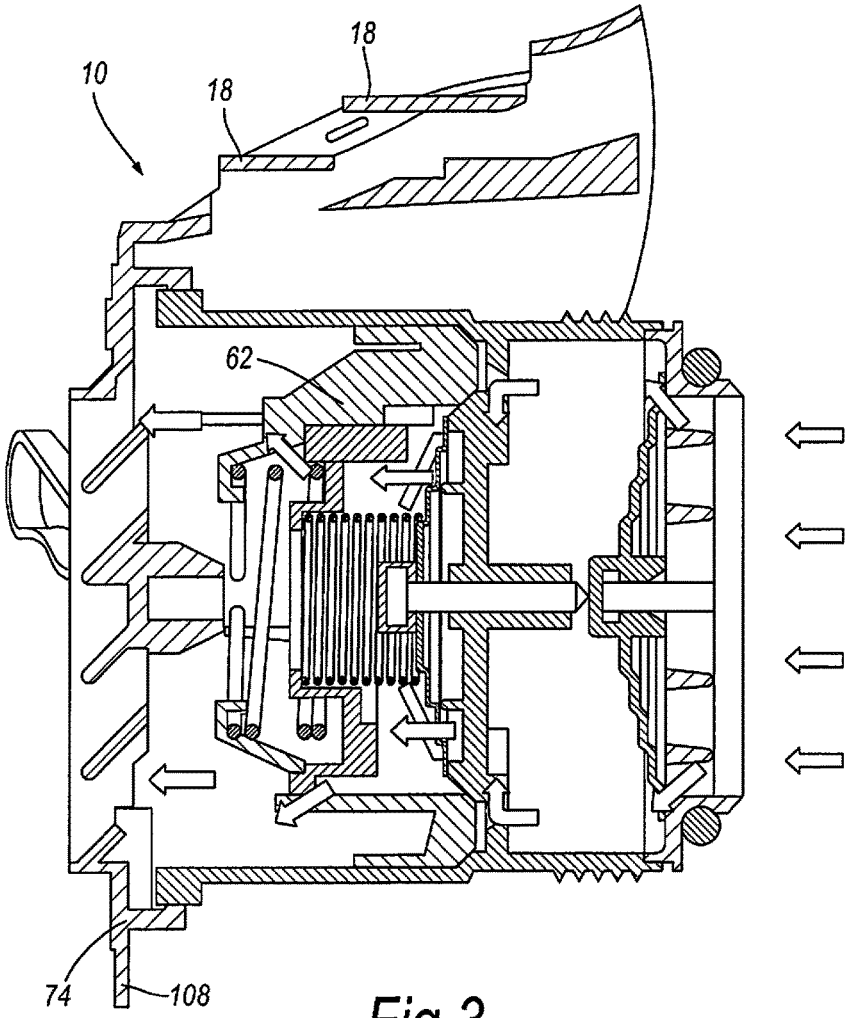
FIG. 3 is a cross-section view of the switchable exhale system shown in FIG. 2 in an active configuration.

Referring to FIGS. 1-3, a switchable exhale filter system 10 (hereinafter "the system 10"), is indicated generally at 10. For the sake of convenience and clarity, terms such as "front," "rear," "top," "bottom," "up," "down," "inwardly," "outwardly," "downstream," "upstream," "lateral," and "longitudinal" will be used herein to describe the relative placement and orientation of the various components of the system 10, all with respect to the geometry and orientation of the exemplary embodiment of the system 10 as it appears in FIGS. 2 and 3. Particularly, the terms "front," "forward," and "downstream" will be used to indicate a position nearer the left side of FIGS. 2 and 3, and the terms "rear," "rearward," and "upstream" will be used to indicate a position nearer the right side of FIGS. 2 and 3. Said terminology will include the words specifically mentioned, derivatives thereof, and words of similar import.

It will be appreciated that the system 10 may be embodied as a removable cartridge assembly, or it may be a built-in feature of a respirator.

The system 10 may include a main housing 12, an APR valve assembly 14, a SCBA valve assembly 16 and an outer cover 18. The components of the system 10 may be formed of various metallic and polymeric materials that will be familiar to those of ordinary skill in the art.

The main housing 12 of the system may be a generally cylindrical body defining an upstream chamber 20 and a downstream chamber 22 that are separated by a partition 24. The partition 24 may comprise a partition flange 26 formed by a plurality of spokes 28 that extend radially inwardly from the partition flange 26 to a central hub 30. The partition flange 26 may have a plurality of central openings 27 (seen in FIG. 1) formed between the plurality of spokes for allowing air to pass through the flange 26 to act on the SCBA valve. The partition flange 26 may also have a plurality of peripheral openings 29 that may act as bypass channels for the SCBA valve, as will be described in greater detail later. The partition flange 26 may further include an intermediate annular rim 32 that, as will be described in greater detail later, serves as a seat for the SCBA valve assembly 16. The peripheral openings 29 may be disposed between the annular rim 32 and the inner surface of the main housing 12 so that they are not sealed by the SCBA valve. The hub 30 may further include a central channel 34 extending therethrough for holding an alignment pin 36 as further described below.

The APR valve assembly 14 may include a valve seat member 38 and a disc member 40. The valve seat member 38 may be defined by a substantially annular body 42 joined by a plurality of spokes 44 to a central hub 46. The spokes 44 may define a plurality of ventilation slits or apertures 48 therebetween for allowing air to pass through the valve seat 38. The valve seat member 38 may include an annular rim 39 that serves as a seat for the disc member 40. The hub 46 may be a substantially cylindrical member having a forwardly extending boss or catch pin 50. The valve seat member 38 may be attached to the rear end of the main housing 12, thereby capping or closing off the upstream chamber 20 as shown in FIGS. 2 and 3. The valve seat 38 may be attached to the rear end of the main housing 12 by snap fit, friction fit, threaded engagement, mechanical fasteners, or adhesives.

The disc member 40 may be a standard flap or diaphragm valve disc composed of a resilient material, such as silicone rubber or other appropriate elastomeric material. Particularly, the valve disc 40 may include a central cylindrical boss 52 that is integral with an annular body portion 54 having a peripheral region 56 configured to seal against the valve seat member 38. A recess 58 may be formed in the rear of the boss 52 to define a cavity or catch. The head of the catch pin 50 of the valve seat member 38 may fit within the recess 58 to hold the two pieces together. The center of the disc member 40 may thereby be securely "clipped" to the valve seat member 38, so that the peripheral region 56 of the disc member is held in sealing engagement with the annular rim 39 of the valve seat member.

The disc member 40 may be configured so that when a first pressure is applied to one side of the disc member (e.g., the pressure of a user's exhaled breath), the disc member deflects away from the annular rim 39, enabling air to pass around the disc member. When the first pressure is removed, the disc member 40 returns to its original position, sealed against the annular rim 39, thereby preventing air from returning in a reverse direction through the APR valve assembly 14. In one non-limiting exemplary embodiment, the first pressure may be about 0.1 mbar to about 3 mbar.

In the illustrated embodiment, an O-ring 60 or other resilient sealing member may be provided on or adjacent to the valve seat member 38 to provide a secure, airtight seal with a respirator mask (not shown) in which the system 10 is disposed.

The SCBA valve assembly 16 of the system 10 may include a bypass member 62, a SCBA valve disc 64, a valve spring plate 66, and a valve spring 68. Also provided are a retaining member 70, a retaining spring 72, and an actuator 74, all of which fit substantially within the downstream chamber 22 of the main housing 12, as can be seen in FIGS. 2 and 3.

As can best be seen in FIG. 1, the bypass member 62 of the positive SCBA valve assembly 16 may be a substantially annular body having a plurality of catch arms 76 and a pair of diametrically opposed axial displacement cams 78 extending from a front edge thereof. Each catch arm 76 may terminate in a hook-shaped catch 80. The bypass member 62 may further include several pairs of receiving arms 82 extending from a front edge thereof, wherein each pair of receiving arms defines an intermediate receiving channel 84 for accepting the first arms 86 of the retainer 70 as will be described below.

The retainer 70 may include a substantially annular central hub 88 having a plurality of first arms 86 extending radially outwardly therefrom. Each first arm 86 may have an L-shaped retaining arm 90 extending forwardly from an outermost end of the associated first arm 86. The retainer 70 may be positioned with respect to the bypass member 62 so that the first arms 86 are seated within the intermediate receiving channels 84 of the bypass member, and so the first arms 86 extend beyond the retainer 70. The tips of the retaining arms 90 may abut and engage a front edge of the main housing 12 (FIG. 2), thereby constrain the retainer 70.

The retaining spring 72 may be a conventional coil spring disposed between the bypass member 62 and the retainer 70. That is, a first end of the retaining spring 72 may engage the catches 80 of the catch arms 76 and a second end of the retaining spring 72 may engage the front surfaces of the first arms 86. The retaining spring 72 is thus held in compression and biases the bypass member 62 and the retainer 70 together.

As will be described in greater detail later, the system 10 uses a cam-type action in which the bypass member 62 seals off a bypass around the SCBA valve assembly 16 to place the system 10 into an SCBA mode. Thereafter, when an activating lever 108 is adjusted to an inactive position, the retaining spring 72 functions to return the bypass member 62 to the inactive position, opening the bypass around the SCBA valve assembly 16 and placing the system 10 into an APR mode.

The SCBA valve disc 64 may be similar to the APR valve disc 40 described above and may be a standard flap or diaphragm valve disc composed of a resilient material, such as silicone rubber or other appropriate material. Particularly, the valve disc 64 may include a central cylindrical boss 92 that is integral with an annular body portion 94 having a peripheral seal region 96. The peripheral seal region 96 is thus configured to seal against the annular rim 32 of the partition 24. A recess 98 may be formed in the rear of the boss 92 to define a cavity or catch. The head of an alignment pin 36 that is securely mounted within the aperture 34 of the hub 30 of the partition 24 may fit within the recess 98 and may be held therein by frictional engagement. The valve disc 64 may thereby be securely "clipped" to the alignment pin 36, thus securing the valve disc 64 in axial alignment with the partition 24. Positioned thusly, the valve disc 64 covers the entire central portion of the partition 24, including the spokes 28 and apertures of the partition 24, and seals against the annular rim 32 of the partition.

The valve spring plate 66 may be a cup-shaped member having a rear surface with a contour that is substantially similar to the contour of the front surface of the valve disc 64. The spring plate 66 may be positioned in abutting relationship with the valve disc 64, and may have a central aperture 100 formed therethrough for receiving the boss 92 of the valve disc 64 to secure the spring plate 66 in axial alignment with the valve disc 64.

The valve spring 68 may be a conventional coil spring positioned between the retainer 70 and the spring plate 66. Particularly, the forward extent of the valve spring 68 may be seated against an annular shoulder 102 defined by the hub 88 of the retainer 70 and the rear extent of the valve spring 68 may be seated against an annular shoulder 104 (FIG. 2) formed in the front surface of the spring plate 66. Positioned thusly, the compressed valve spring 68 biases the spring plate 66 and the valve disc 64 rearward, thereby holding the periphery of the valve disc 64 in firm engagement with the annular rim 32 of the partition 24 and forming a seal therebetween. The opening pressure of the SCBA valve assembly 16 (which may be referred to as a "second pressure" as compared to the "first pressure" which represents the opening pressure of the APR valve) may thus be adjusted through careful selection of the spring constant of the valve spring 68. In one embodiment, the valve spring 68 is selected to provide an opening pressure of the SCBA valve assembly 16 which is greater than a cracking pressure of a demand valve for a compressed air supply (not shown) when the respirator operates in a mode utilizing a compressed air supply, as will be described in greater detail below. The opening pressure of the SCBA valve assembly 16 may be greater than the opening pressure of the APR valve assembly 14. In one non-limiting exemplary embodiment, this opening pressure of the SCBA valve assembly 16 may be from about 3.5 mbar to about 6.5 mbar.

The actuator member 74, which is best viewed in FIG. 1, comprises a circular body 105 having a central opening 106 for receiving a mounting shaft (not within view) that extends rearwardly from the cover 18. An actuation lever 108 may extend radially outward from the circular body 105 through an opening in the cover to allow a user to rotate the actuator 74. A plurality of cam followers 110 may extend rearwardly from the circular body 105 and comprise curved cam follower surfaces that are configured to engage the cams 78 of the bypass member 62 so that as the actuator member 74 is rotated in a first direction the bypass member 62 is moved axially toward the partition 24 of the main housing 12, and as the actuator member 74 is rotated in a second direction the bypass member 62 is moved axially away from the partition.

Thus, in a first position (shown in FIG. 2), the bypass member 62 is positioned away from the partition 24 such that the rear extent of the bypass member 62 does not block the peripheral openings 29 in the partition 24. As such, exhaled air is allowed to travel through the peripheral openings 29, bypassing the SCBA valve assembly 16, so that only the APR valve assembly 14 is "in line." This is referred to as the "APR" mode, and the air flow in this mode is shown by the arrows illustrated in FIG. 2. To configure the system 10 into the "SCBA" mode (shown in FIG. 3), the actuator member 74 is rotated so that the cam followers 110 engage the cams 78 of the bypass member 70, pushing the bypass member against the partition 24 of the main housing 12, and sealing off the peripheral openings 29 in the partition. As such, exhaled air is prevented from bypassing the SCBA valve assembly 16, and instead the air is forced through the central openings 27 of the partition 24 so that it acts against the SCBA valve disc 64. Air flow in this mode is shown by the arrows illustrated in FIG. 3.

The system 10 of the present disclosure is therefore operable in two different modes: an APR mode and a SCBA mode. As noted, to operate the system 10 in the APR mode, the actuation lever 108 is rotated so that the bypass member 62 assumes the position shown in FIG. 2. Configured thusly, when air pressure inside the mask is negative during inhalation by a user, the APR valve disc 40 is forced closed and air may only enter the mask through an air purification element (i.e., a filter) located upstream of the APR valve disc 40. When the user exhales, the exhalation pressure inside the mask overcomes the opening pressure (i.e., the first pressure) of the APR valve disc 40, thereby opening the APR valve and allowing the air into the upstream chamber 20 of the main housing 12. Since the peripheral openings 29 in the partition 24 are not blocked by the bypass member 62, the exhaled air passes freely through the perforations, bypassing the closed SCBA valve disc 64, and is expelled through the cover 18 of the system 10. The user is therefore able to inhale purified air and exhale freely as with a conventional APR unit.

To operate the system 10 in the SCBA mode, the user rotates the actuation lever 108 so that the bypass member 62 engages the partition 24 as shown in FIG. 3. In this mode, a positive pressure (below that of the opening pressure of the SCBA valve 16) can be maintained within the mask to prevent ingress of hazardous gases during use. Since, in this mode, the bypass member 62 has been moved to block the openings in the partition flange 26, exhaled air is not allowed to bypass the SCBA valve disc 64 and is instead forced to pass through the central openings 27 in the partition 24 and to confront the SCBA valve disc 64. During exhalation, the combined pressure of the compressed air and the exhaled air is sufficient to overcome the opening pressure of the SCBA valve disc 64. The SCBA valve disc therefore opens during exhalation and allows the exhaled air (and the compressed air) to flow into the downstream chamber 22 of the main housing 12 and exit through the cover 18. The user is therefore able inhale purified air supplied by the compressed air source and to exhale freely as with a conventional SCBA unit. Moreover, the positive air pressure within the mask prevents external air from entering the mask while the SCBA pressure valve 64 prevents air in the mask from freely escaping from the system 10.

It will be appreciated that many alternative mechanical configurations of the system 10 may be implemented for providing similar functionality as that described above. Fundamentally, any such configuration should feature an APR valve having a first opening pressure and a SCBA valve having a second opening pressure that is greater than the first opening pressure, wherein a user can select operation of the system in either an APR mode or a SCBA mode by selectively engaging a set of bypass channels. Such selection can be manual, or it can be automated.

Figure 4:
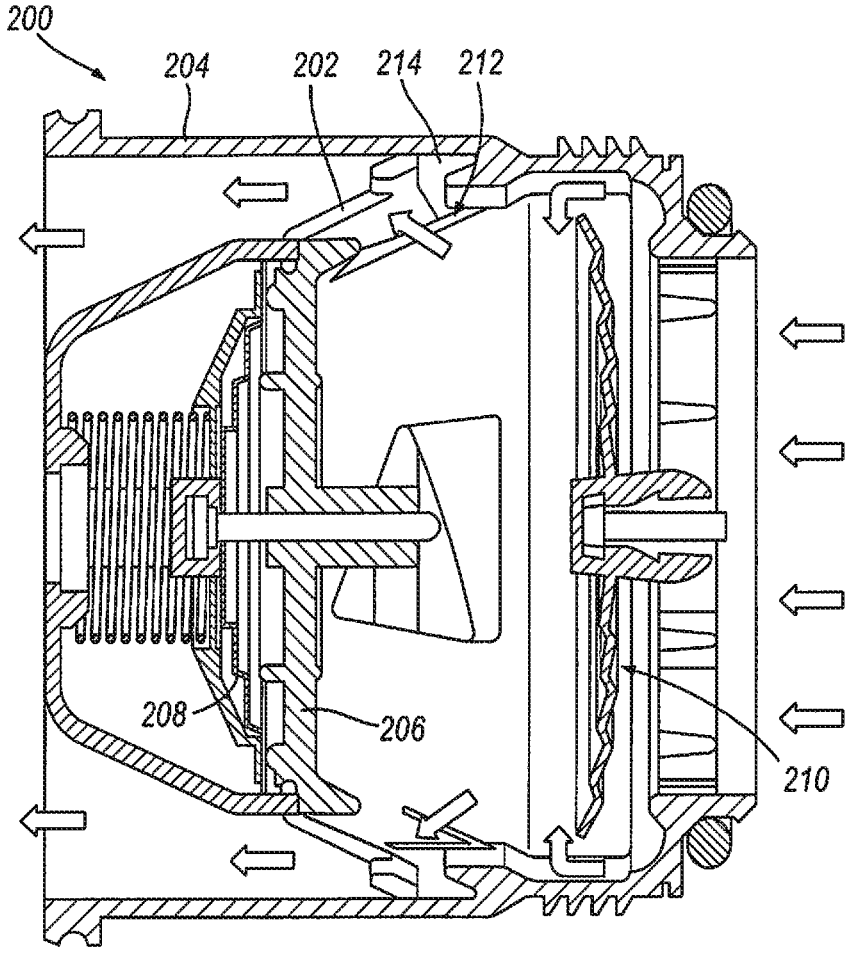
FIG. 4 is a cross-section view of an alternative embodiment of a switchable exhale system in accordance with the present disclosure in an inactive configuration.
Figure 5:
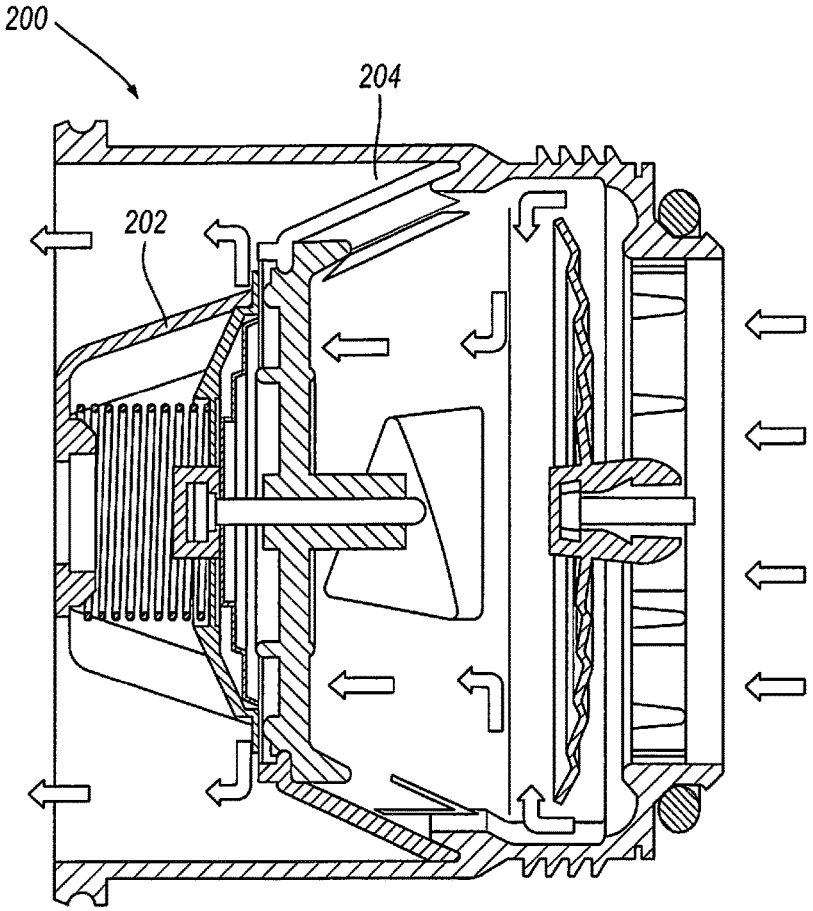
FIG. 5 is cross-section view of the alternative embodiment of the switchable exhale system shown in FIG. 4 in an active configuration.

An exemplary alternative embodiment of a system 200 in accordance with present disclosure is illustrated in FIGS. 4 and 5, wherein a rotatable bypass member 202 is disposed within a housing member 204. The system includes an intermediate partition member 206 having a plurality of openings (not shown) through which air is movable to contact a SCBA valve assembly 208. The system 200 also includes an APR valve assembly 210 similar to the APR valve assembly described in relation to the embodiment of FIGS. 1-3. The rotatable bypass member 202 includes a plurality of openings 212 in a wall thereof. In addition, a plurality of openings 214 are formed between the housing member 204 and the intermediate partition member 206. In a first configuration (the "APR" mode, shown in FIG. 4), the rotatable bypass member 202 is positioned so that the openings 212 of the bypass member are aligned with the openings 214 formed between the housing member and the intermediate partition member, thus enabling exhaled air to bypass the SCBA valve assembly 208. The air flow pattern for this mode is shown by the arrows in FIG. 4. To configure the system 200 into SCBA mode (shown in FIG. 5), the rotatable bypass member 202 is rotated so that the openings 212 are not aligned with the openings 214 formed between the housing member and the intermediate partition member, thus blocking the openings 214 and forcing exhaled air to engage the SCBA valve assembly 208.

As with the previous embodiment, the APR valve assembly 210 may have an opening pressure that is lower than an opening pressure of the SCBA valve assembly 208.

This disclosed systems 10, 200 may find application in any mask where APR, PAPR or SCBA can be used together in some form.

What is claimed is:

1. A configurable exhale system for a respirator, the system comprising:

a housing having a chamber;

a first valve assembly disposed within the chamber and configured to prevent air from flowing through the first valve assembly when an air pressure differential between an upstream side and a downstream side of the first valve assembly is below a first opening pressure;

a second valve assembly disposed within the chamber in fluid communication with the first valve assembly, the second valve assembly configured to prevent air from flowing through the second valve assembly when an air pressure differential between an upstream side and a downstream side of the second valve assembly is below a second opening pressure, where the second opening pressure is greater than the first opening pressure;

at least one bypass opening positioned adjacent the second valve assembly, the at least one bypass opening configured to enable air to bypass the second valve assembly; and a bypass member positioned adjacent the at least one bypass opening, the bypass member movable between first and second positions, wherein in the first position the bypass member blocks the at least one bypass opening, and wherein in the in the second position the bypass member does not block the at least one bypass opening.

2. The configurable exhale system of claim 1, wherein moving the bypass member between the first and second positions comprises axial movement of the bypass member.

3. The configurable exhale system of claim 1, wherein moving the bypass member between the first and second positions comprises rotational movement of the bypass member.

4. The configurable exhale system of claim 1, wherein the system is integrated with the respirator.

5. The configurable exhale system of claim 1, wherein, in use, moving the bypass member between the first and second positions is initiated manually by a user.

6. The configurable exhale system of claim 1, wherein moving the bypass member between the first and second positions is initiated automatically based on a change of state or an aspect of a respirator associated with the system.

7. The configurable exhale system of claim 6, wherein the change of state or an aspect of a respirator associated with the system is selected from the list consisting of: the wearer, in use, rotating an actuator member, enabling a function of a demand valve, and creating an abnormal pressure condition in an internal volume of the respirator.

8. A method for providing a switchable exhale filter system for a respirator, the method comprising:

providing a housing having a first and second valve assemblies in fluid communication with each other; the first valve assembly configured to prevent air from flowing through the first valve assembly when an air pressure differential between an upstream side and a downstream side of the first valve assembly is below a first pressure; the second valve assembly configured to prevent air from flowing through the second valve assembly when an air pressure differential between an upstream side and a downstream side of the second valve assembly is below a second pressure; the second pressure being greater than the first pressure;

providing at least one opening adjacent the second valve assembly for allowing air to bypass the second valve assembly; and providing a bypass member adjacent the at least one opening; and moving the bypass member between first and second positions, wherein in the first position the bypass member does not block the at least one opening and allows air to flow through the at least one opening to bypass the second valve assembly, and wherein in the second position the bypass member blocks the at least one opening to prevent air from bypassing the second valve assembly.

9. The method of claim 8, wherein moving the bypass member between the first and second position comprises moving the bypass member axially.

10. The method of claim 9, wherein moving the bypass member between the first and second position comprises rotating the bypass member.

11. The method of claim 8, wherein the system is integrated with the respirator.

12. The method of claim 8, wherein moving the bypass member between first and second positions is initiated manually by a user.

13. The method of claim 8, wherein moving the bypass member between first and second positions is initiated automatically based on a change of state or an aspect of a respirator associated with the system.

14. The method of claim 13, wherein the change of state or an aspect of a respirator associated with the system is selected from the list consisting of: the wearer rotating an actuator member, enabling a function of a demand valve, and creating an abnormal pressure condition in an internal volume of the respirator.

* * * * *